US005762031A

United States Patent [19]

Gurevich

[11] Patent Number: 5,762,031

[45] Date of Patent: Jun. 9, 1998

[54] VERTICAL DRUM-TYPE BOILER WITH ENHANCED CIRCULATION

[76] Inventor: Arkadiy M. Gurevich, 3002 Bradford Grove La., Louisville, Ky. 40220

[21] Appl. No.: 848,124

[22] Filed: Apr. 28, 1997

[51] Int. Cl.[6] ..... F22D 1/00

[52] U.S. Cl. ..... 122/7 R; 122/1 C

[58] Field of Search ..... 122/7 R, 1 C

[56] References Cited

U.S. PATENT DOCUMENTS

| | | |
|---|---|---|
| 3,561,405 | 2/1971 | Tramota . |
| 3,719,172 | 3/1973 | Charcharos . |
| 3,807,364 | 4/1974 | Schwartz . |
| 4,627,386 | 12/1986 | Duffy et al. . |
| 4,638,765 | 1/1987 | Skinner . |
| 4,721,065 | 1/1988 | Mohrenstecher . |
| 4,795,570 | 1/1989 | Lemeris . |
| 4,858,562 | 8/1989 | Arakawa et al. . |
| 4,920,926 | 5/1990 | Linke et al. . |
| 4,989,405 | 2/1991 | Duffy et al. . |
| 5,109,665 | 5/1992 | Hoizuni et al. . |
| 5,267,434 | 12/1993 | Termuehlen et al. . |
| 5,273,002 | 12/1993 | Balint et al. . |
| 5,293,842 | 3/1994 | Loesel . |
| 5,347,958 | 9/1994 | Gordon . |
| 5,370,086 | 12/1994 | Saujet et al. . |
| 5,419,284 | 5/1995 | Kobayashi et al. . |
| 5,452,686 | 9/1995 | Stahl . |

OTHER PUBLICATIONS

Combined Cycle Systems –Tapada do Outeiro, May, 1996.
Turbo Machinery International, Jul./Aug. 1996.

*Primary Examiner*—Henry A. Bennett
*Assistant Examiner*—Jiping Lu
*Attorney, Agent, or Firm*—Wheat, Camoriano, Smith & Beres, PLC

[57] ABSTRACT

A vertical boiler with horizontal evaporator tubes is provided. The evaporator is divided into two sections, which are connected in parallel to the drum. The first evaporator section relies on the feedwater pump to provide forced circulation. The second evaporator section relies primarily on natural circulation but may also be assisted by the feedwater pump. This design provides a vertical boiler which is reliable under all operating conditions, including start-up, transient conditions, and steady state conditions, without requiring the use of circulating pumps or an auxiliary energy source (steam, water, gas, etc.).

15 Claims, 3 Drawing Sheets

VERTICAL DRUM-TYPE BOILER WITH ENHANCED CIRCULATION

BACKGROUND OF THE INVENTION

The present invention relates to boilers, and, in particular, to vertical gas flow boilers having horizontal tubes. While the examples of the invention described herein relate mainly to heat recovery steam generators and refer to water as the working fluid, the present invention may be used in other boilers, in nuclear reactors, and in other heat exchangers where there is two-phase flow.

Heat recovery steam generators are boilers which take waste heat (usually from a gas turbine) and use it to make steam. Two basic types of heat recovery steam generators (boilers) are known—vertical gas flow boilers (vertical boilers) and horizontal gas flow boilers (horizontal boilers).

Horizontal boilers are widely used in the United States and have the advantage that they operate by natural circulation. The tubes in which heat exchange occurs are vertical, and the difference in density between the water going into the heat exchange tubes and the water/steam mixture in the tubes and between the tubes and the drum acting over a height creates the driving force which causes the natural circulation. Horizontal boilers use a feedwater pump, but they do not require expensive circulating pumps and associated valves and piping, and they do not require large expenditures of energy to operate circulating pumps. However, horizontal boilers are more complex in operation; they are difficult to clean; they have a relatively large footprint (and therefore take up a lot of floor space); and the heat transfer in a horizontal boiler is not as efficient as in a vertical boiler.

Vertical boilers are commonly used in Europe and have the advantage that they have a small footprint; the boiler itself serves as a stack, so it is not necessary to build a large stack, as is necessary with horizontal boilers; they are easy to clean; and they have more efficient heat transfer. Also, because vertical boilers use circulating pumps to pump the water through the evaporators, they have good control over the water velocities inside the evaporator tubes. The great disadvantage of vertical boilers is that they require expensive circulating pumps and associated valves and piping, and they require expenditures of energy to operate those pumps.

Forced circulation vertical boilers include both a feedwater pump and circulating pumps. The circulating pumps in typical forced circulation vertical boilers pump approximately 5–8 times the flow rate of the feedwater pump, depending upon the circulation ratio of the boiler. Also, the circulating pumps operate at much higher temperatures than does the feedwater pump and sometimes have a very high inlet pressure, requiring expensive pumps and large expenditures of energy. It would be very desirable to be able to eliminate these circulating pumps, which create such a large expense.

A natural circulation vertical boiler with horizontal evaporator tubes would be the best of both worlds, eliminating the expense of the circulating pumps and the energy they use, while having all the benefits of a vertical boiler. However, so far, it has not been possible to make such a boiler that would be reliable, because the driving head of the natural circulation vertical boiler with horizontal tubes is not enough to reliably create sufficient velocity in the evaporator tubes.

The only source of a natural circulation driving head in a vertical boiler is the difference between the water density in the downcomers and the density of the steam-water mixture in the risers applied over the height of the risers. The density difference between the steam-water mixture in the evaporator tubes and the water density in the downcomers cannot be used to cause circulation, because the height of the tubes is zero (for horizontal tubes). Therefore, there is a relatively low driving head. The problem is made worse, because there is a large pressure drop in the horizontal tubes of the evaporator, which means that the driving head may be barely sufficient, and at times insufficient, to cause the necessary natural circulation. Also, the startup of such boilers is a problem, because there is no source of natural circulation until there is a steam/water mixture in the risers. This means that an auxiliary source of steam must be used to heat up the risers to get the natural circulation started, or some other external means must be used, which creates its own problems.

SUMMARY OF THE INVENTION

The present invention provides an improved vertical boiler which does not require the expensive circulating pumps of prior art vertical boilers but still ensures adequate flow rates through the evaporators during any and all steady state and transient load conditions, including during startup, without the need for auxiliary steam sources or other external means.

The present invention provides a vertical boiler in which each evaporator is divided into two sections—a first section, which is driven by the feedwater pump, and a second section, which relies primarily on natural circulation.

A large portion of the evaporation occurs in the first evaporator section, and, since the flow which passes through the first evaporator section does not pass through the second evaporator section, this removes a substantial flow of steam from the second evaporator section, thereby reducing the pressure drop in the second evaporator section, which makes it easier for the natural head to drive the circulation in the second evaporator section.

In addition, in a preferred embodiment of the invention, the feedwater pump also effectively enhances the circulation in the second evaporator section by providing injectors at the point at which the output of the first evaporator section merges with the output of the second evaporator section, so that the flow of the first evaporator section helps drive the flow in the second evaporator section.

DESCRIPTION OF THE PREFERRED EMBODIMENTS

Figure 1:
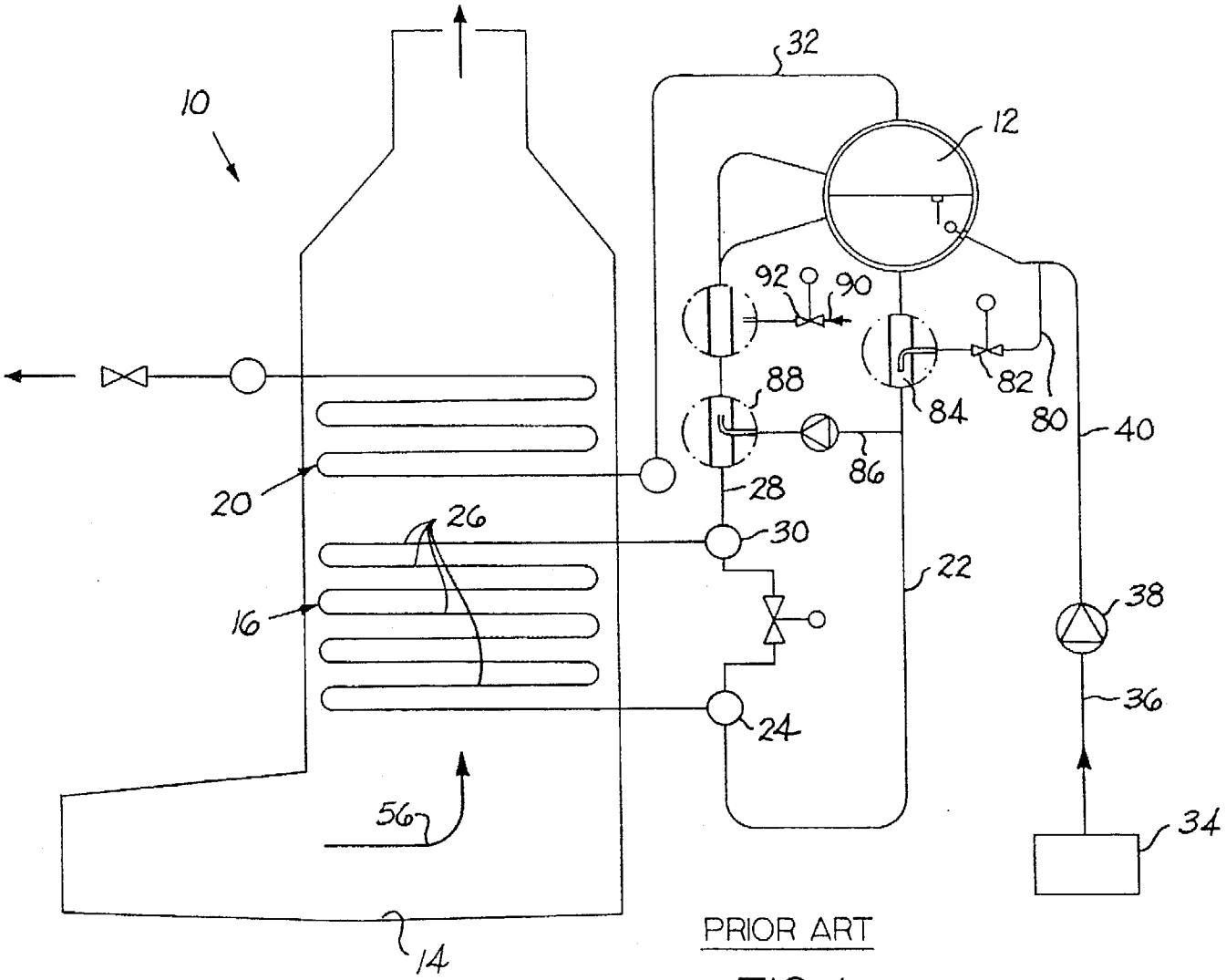
PRIOR ART FIG. 1
FIG. 1 shows a prior art vertical boiler relying on natural circulation.

Referring first to FIG. 1, which is a drawing from EP0357590 B1, there is a prior art vertical boiler 10, which relies primarily on natural circulation. As was explained above, this type of boiler has been impractical due to the unreliability of the natural circulation. Also, the injector system in this design is not very effective.

The boiler 10 includes a steam drum 12, which is a pressurized drum, holding saturated steam and liquid water. While this figure is simplified, it will be understood by those skilled in the art that there should be more than one steam drum 12 in a boiler, with multiple pressure levels, and with a different drum 12 at each different pressure level, and the arrangement shown here would be repeated for each pressure level.

There is a gas duct 14, through which the hot gases pass, and there is an evaporator 16 inside the gas duct. There may also be an economizer (not shown) and a superheater 20 inside the gas duct. The economizer (not shown), evaporator 16, and superheater 20 all include horizontal tubes which absorb heat from the hot gas passing through the gas duct 14.

There is at least one downcomer 22 from the drum 12, which brings water to the inlet header 24 of the evaporator 16. There may be more than one downcomer 22 directing water to the inlet header 24. The tubes 26 of the evaporator 16 are substantially horizontal and receive water from the inlet header 24. While only a few evaporator tubes 26 are shown here, it will be understood that there may be many tubes 26. There is at least one riser 28, and preferably several risers 28, which transport a steam/water mixture from the outlet header 30 of the evaporator 16 to the drum 12. There is also a steam line 32 from the drum 12, which transports saturated steam from the drum 12 to the superheater 20.

Water is supplied to the boiler 10 from the deaerator 34. It is understood by those skilled in the art that the dearator 34 is in fluid communication with a condenser (not shown) and with a make-up water source (not shown). There is a water feed line 36 from the deaerator 34 to the feedwater pump 38, and there is a pump outlet line 40, which transports water to the drum 12. There is a drum bypass line 80, with a control valve 82, which leads to an injector 84 into the downcomer line 22. This drum bypass line 80 is used during start-up, using the feedwater pump 38 to create a driving head to cause water to circulate in the tubes 26 of the evaporator 16. There is also a second bypass line 86 with an injector 88, which again is used to create a driving head during start-up. There is also a steam or gas inlet line 90, with a valve 92, which is used during start-up.

The hot gas leaving a gas turbine (not shown) flows along the path shown by the arrow 56, through the gas duct 14. It should be noted that, while a gas turbine is the usual source of hot gas to the boiler, other sources of hot gas may also be used.

The operation of the system of FIG. 1 is as follows:

Water goes from the drum 12, down the downcomer 22, to the inlet header 24 of the evaporator 16, and through the tubes 26 of the evaporator 16, where some of the water is converted to steam. The steam/water mixture leaves the evaporator tubes 26 through the outlet header 30, through the riser 28, and returns to the drum 12. The circulation from the drum 12, through the evaporator 16, and back to the drum 12 is driven by the difference between the density of the water in the downcomer 22 and the density of the water/steam mixture in the riser 28 over the height of the riser 28. The lower density steam/water mixture in the evaporator tubes 26 does not help drive the circulation, because the tubes are horizontal, having no height.

Steam from the drum 12 goes through the steam line 32, through the tubes of the superheater 20, and out of the boiler 10. The feedwater pump 38 provides the water necessary to make up the steam which leaves through the superheater 20. The feedwater pump 38 pumps water to the drum.

The ratio of the flow rate of water flowing down the downcomer 22 to the flow rate of steam going up the risers 28 or through the steam line 32 is the circulation ratio of the boiler.

As was discussed in the background section, the driving head of the evaporator risers 28 is relatively low; the driving head of the horizontal tubes 26 of the evaporator 16 is zero; and the pressure drop caused by the motion of the steam/water mixture in the evaporator tubes 26 is relatively high. These circumstances result in relatively low velocities in the evaporator tubes 26 and make the natural circulation in this boiler unreliable. An auxiliary steam source (which enters through line 90) is needed to heat the water in the risers 28 in order to provide the initial driving head for natural circulation before starting up the gas turbine and before starting up the boiler 10. A disadvantage of using auxiliary steam is swell (raising the water level) in the drum. The bypass lines 80, 86 and injectors 84, 88 are also used during start-up to create the driving head.

Figure 2:
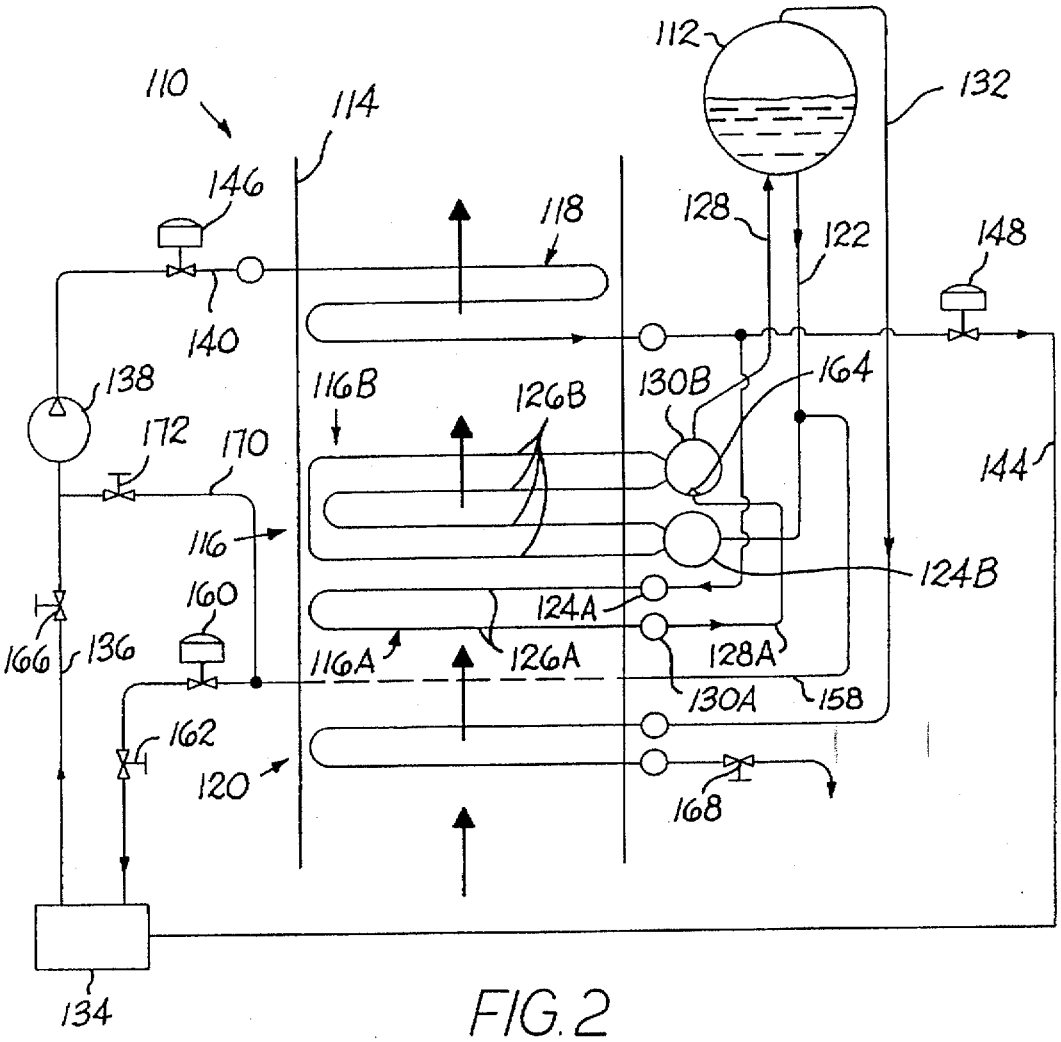
FIG. 2 shows a first embodiment of a boiler made in accordance with the present invention.

FIG. 2 shows a preferred embodiment of the present invention. This boiler 110 includes a drum 112 and a gas duct 114. An evaporator 116, an economizer 118, and a superheater 120 are inside the gas duct 114. There is a deaerator 134, and a feedwater pump 138, as in the prior art.

One of the main differences between this system and the prior art is that, in this system, the evaporator 116 is divided into two sections 116A, 116B, which are connected to the drum 112 in parallel. The first evaporator section 116A uses forced circulation, depending upon the feedwater pump 138 to pump water through this portion of the evaporator. The second evaporator section 116B relies primarily on natural circulation.

The downcomer (or downcomers) 122 from the drum 112 transports water to the inlet header 124B of the second evaporator section 116B, and there is a second recirculation line 158 leading from the drum 112 back to the deaerator 134, with a control valve 160 and a stop valve 162 in the second recirculation line 158. (The first recirculation line 144 returns water from the economizer 118 to the deaerator 134.)

Figure 3:
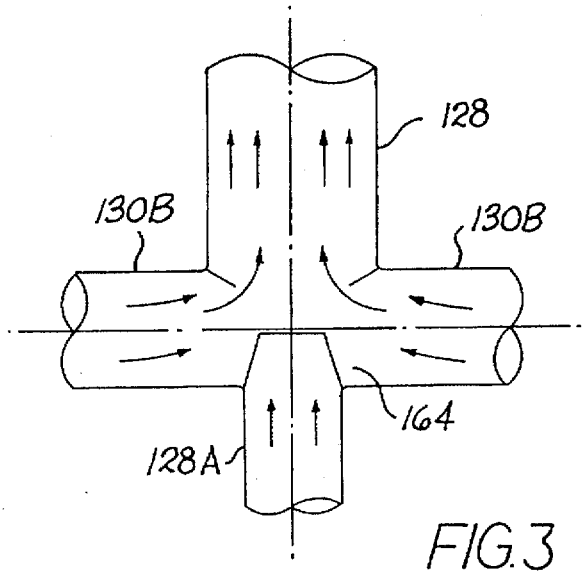
FIG. 3 is an enlarged view of the injector portion of FIG. 2.

The first evaporator section 116A receives water from the feedwater pump 138. The feedwater is pumped through the economizer 118, to the inlet header 124A of the first evaporator section 116A, through the tubes 126A of the first evaporator section 116A, where some of the water is converted to steam; then the steam/water mixture is pumped through the outlet header 130A of the first evaporator section, and out the first evaporator section connecting line 128A to the outlet header 130B of the second evaporator section 116B. So, the outlet of the first evaporator section 116A is combined with the outlet of the second evaporator section 116B at the outlet header 130B. The output of the first evaporator section 116A passes through one or more injectors 164 as it merges with the output of the second evaporator section 116B, and the injectors create a driving head which helps draw fluid through the second evaporator section 116B. An enlarged view of one of the injectors 164 is shown in FIG. 3. By using the injectors 164, the feedwater pump 138 also assists with the circulation in the second evaporator section 116B. The combined stream from the evaporator 116 then flows through the second riser 128 to the drum 112.

Since a large portion of the steam that is generated in the evaporator 116 is generated in the tubes 126A of the first evaporator section 116A, this takes a large steam load off of the tubes 126B of the second evaporator section 116B, so the pressure drop in the second evaporator section 116B is greatly reduced from what it was in the corresponding portion of the evaporator 16 of the prior art arrangement. By reducing the pressure drop across the evaporator section 116B and using injectors 164 to help pump fluid through the second evaporator section 116B, the circulation in this section 116B becomes much more reliable than it was in the evaporator 16 of the prior art.

While FIG. 2 shows only a single drum 112, it will be understood that more than one drum could be present, with the arrangement of economizer, two-section evaporator, and superheater shown in FIG. 2 repeated for each drum. Also, while only a few tubes are shown in FIG. 2, it is understood that there may be many tubes and many risers 128. Also, while the first evaporator section connector line 128A directs the fluid flowing out of the first evaporator section 116A to the outlet header 130B of the second evaporator section 116B, where it merges with the fluid flowing out of the second evaporator section 116B, it is understood that the connector line 128A could merge with the riser 128 at another point, or the connector line 128A could go directly to the drum 112. The important point is that the first evaporator section connector line 128A provides fluid communication from the outlet 130A of the first evaporator section 116A to the drum, so that the first and second evaporator sections 116A, 116B are connected to the drum 112 in parallel.

The control valve 146 in the feedwater pump outlet line 140 is regulated to control the level of water in the drum 112, and, at steady state, the amount of water being pumped through the feedwater pump outlet line 140 is equal to the amount of steam leaving the superheater 120. The control valve 148 in the first recirculation line 144 is regulated to prevent steaming in the economizer 118.

There is a start-up line 170, which is a branch from the second recirculation line 158 to the feedwater pump inlet line 136, and there is a shut-off valve 172 in the start-up line 170, which is closed except during start-up.

During boiler operation at steady state or transient conditions, the stop valve 166 in the water inlet line 136 and the stop valve 162 in the second recirculation line 158 are always open. At steady state load conditions, the control valve 146 in the pump outlet line 140 maintains the water level in the steam drum 112 by changing the delivery of the feedwater pump 138 while the control valve 160 in the second recirculation line 158 is closed. In this case, the water flow through the economizer 118 and the steam/water mixture flow through the first evaporator section 116A are equal to each other and equal to the total steam production of the boiler.

At transient conditions, the water level in the drum 112 may be maintained in two possible scenarios.

To increase the water level in the drum: There may be a need to increase the delivery from the feedwater pump 138 to the drum 112 if the water level in the drum 112 goes down. This is accomplished by increasing the opening of the control valve 146 in the pump output line 140. The control valve 160 in the second recirculation line 158 remains closed.

To decrease the water level in the drum: If the water level in the drum 112 goes up, it is necessary to send some water from the drum 112 through the second recirculation line 158 to the deaerator 134 or to the feedwater pump suction line 136. To decrease the amount of water in the drum 112, the position of the control valve 146 in the pump output line 140 remains almost unchanged, which results in the delivery of feedwater to the drum 112 being almost unchanged. In this situation, the control valve 160 in the second recirculation line 158 is opened, and some boiler water from the drum 112 will pass down to the pump suction 136, which will be used to maintain the water level in the drum 112 constant.

The almost unchanged flow rate through the feedwater pump output valve 146, economizer 118, and evaporator first section 116A will stabilize and keep almost unchanged the driving head of the injectors 164 in the risers 128, which, in turn, will contribute to the stable circulation in the evaporator section 116B during transient conditions. When the transient condition ends, the control valve 160 in the second recirculation line 158 will close, and the water level in the drum 112 will be controlled as before, by changing the position of the control valve 146 in the feedwater pump outlet line 140.

During startup: During startup of the boiler, the water which is already in the boiler is recirculated within the boiler until the desired operating conditions are reached. The valves 166 and 160 are closed, and the start-up line valve 172 is open.

First, the feedwater pump 138 will be started. Immediately after the feedwater pump 138 is started, the gas turbine or other source of hot gas will be started. The hot gas is directed through the gas duct 114. The first evaporator section 116A, which has forced circulation from the feedwater pump 138, begins absorbing heat from the gas stream, forming a steam-water mixture which passes through the first riser tube 128A, through the injectors 164, and through the second risers 128, delivering the steam-water mixture to the drum 112. The flow of fluid through the injectors 164 and the difference in density between the water coming down the downcomer 122 and the steam-water mixture going up the risers 128 create an initial driving head, which will initiate circulation in the second evaporator section 116B.

The following hydraulic picture takes place. First, there is flow from the drum 112, down the downcomer(s) 122, through the second recirculation line 158, through the start-up line 170, through the feedwater pump 138, through the economizer 118, through the first evaporator section 116A, through the first riser 128A, through the injector 164, through the second riser 128, and back to the drum. Second, there is a flow from the drum 112, through the downcomer 122, through the second evaporator section 116B, through the second risers 128, and back to the drum 112.

Because of steam production in the evaporator tubes 126A, 126B, the pressure in the boiler 110 during startup increases until it reaches the nominal value at which the feed water inlet valve 166 will open, the main stop valve 168 at the outlet of the superheater 120 will open, and steam will begin to leave the boiler 110 and go to the consumer. By the end of startup, steady state will be reached, and the start-up valve 172 is then closed.

Using the design shown in FIG. 2, there is no need for an auxiliary steam (heat) source to heat the risers during startup in order to initiate natural circulation. This also means that there will not be an excessive swell in the boiler steam drum during startup, because there will not be an additional steam input into the boiler circulation loop.

Thus, it can be seen that the design of FIG. 2 will operate reliably during startup, during transient conditions, and during steady state conditions, without the need for circulating pumps or external sources of steam. This design uses only the feedwater pump, which is standard equipment on all vertical and horizontal boilers, and, by separating the evaporator into two sections, one using forced circulation and the other using primarily natural circulation, achieves results that were not possible before.

Figure 4:
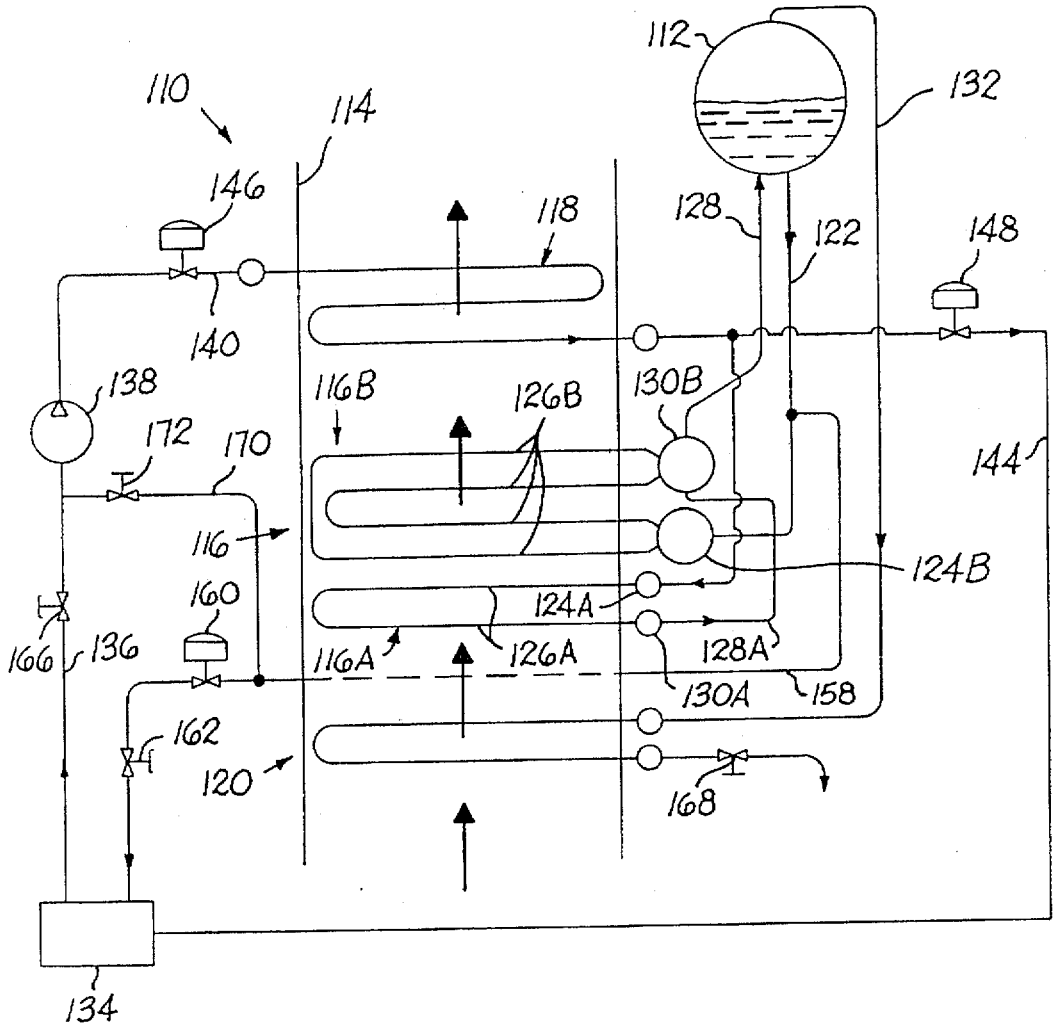
FIG. 4 is a second embodiment of a boiler made in accordance with the present invention.

FIG. 4 shows a second embodiment of the invention. This embodiment is identical to the embodiment of FIG. 2, except that no injectors are used where the output of the first evaporator section 126A merges with the output of the second evaporator section 126B. This design does not include the advantage of using the injectors to assist the flow in the second evaporator section, but it still performs much better than any prior art system.

The following results have been calculated to show the difference in performance between the boiler of FIG. 1 and the boiler of FIG. 4.

| | Figure 1 boiler (10) | Figure 4 boiler (110) |
|---|---|---|
| Total number of evaporator rows | 10 | 10 |
| Number of rows with forced circulation (FC) | 0 | 2 |
| Steam production in rows with forced circulation (FC), % | 0 | 40.2 |
| Total circulation ratio | 10.3 | 14.8 |
| Minimum circulation ratio in rows | 4.3 | 7.9 |
| Minimum water velocities in rows, ft/sec. | 3.4 | 4.4 |

It will be noted that 40.2% of the steam produced in the boiler of FIG. 4 is produced in the first evaporator section 112A, relieving the second evaporator section 112B of 40% of the steam that would otherwise be going through if the evaporator were not divided into parallel sections. This greatly reduces the pressure drop in the second evaporator section 112B, making it much easier for natural circulation to occur.

A higher circulation ratio in the rows may be desirable in order to ensure a reliable metal temperature in the tubes. A good design practice would be not to allow the circulation ratio in the rows to fall below 4. The design of FIG. 1 falls very close to 4, while the design of FIG. 4 is substantially above 4, ensuring reliable operation. The minimum water velocity calculated in the rows of the FIG. 1 boiler is 3.4 feet per second, while the minimum water velocity in the FIG. 4 boiler is 4.4 feet per second, or an improvement of 29%.

It should also be noted that the design of FIG. 4, for which these values have been calculated, does not include the advantage of the injectors 164 of the FIG. 2 design. Thus, the values for the design of FIG. 2 should be even better than those for the FIG. 4 design.

It will be obvious to those skilled in the art that modifications may be made to the embodiments of the invention described above without departing from the scope of the invention.

What is claimed is:

1. An evaporator system, comprising:

a drum;

a substantially vertical gas duct through which hot gas can pass;

first and second evaporator sections located in said gas duct, each of said evaporator sections defining an inlet and an outlet and including substantially horizontal heat-absorbing tubes;

a feedwater pump in fluid communication with the inlet of said first evaporator section;

a downcomer from said drum in fluid communication with the inlet of said second evaporator section;

a connecting line providing fluid communication between the outlet of said first evaporator section and said drum; and a riser providing fluid communication between the outlet of said second evaporator section and said drum, wherein said first and second evaporator sections are connected in parallel to said drum through said connecting line and said riser.

2. An evaporator system as recited in claim 1, and further comprising an economizer section, including a plurality of substantially horizontal tubes located in said gas duct above said first and second evaporator sections, said economizer section including an inlet and an outlet, wherein the outlet of said economizer section is in fluid communication with the inlet of said first evaporator section and the inlet of said economizer section is in fluid communication with said feedwater pump.

3. An evaporator system as recited in claim 2, wherein said feedwater pump pumps water through the economizer and into the first evaporator section.

4. An evaporator system as recited in claim 3, and further comprising a first recirculation line in communication with the outlet of said economizer section and with the inlet of the feedwater pump, and a control valve in said first recirculation line, which can be used to prevent steaming in the economizer section.

5. An evaporator system as recited in claim 4, and further comprising a second recirculation line, in communication with the drum and with the feedwater pump inlet.

6. An evaporator system as recited in claim 5, wherein said system includes a deaerator in fluid communication with said feedwater pump, so that the feedwater pump pumps deaerated water into the system, wherein said second recirculation line includes two branches:

a first branch which goes to the deaerator and includes a valve; and a start-up branch, which goes to the inlet of the feedwater pump and includes a valve.

7. An evaporator system as recited in claim 1, and further comprising an injector in fluid communication with said connecting line and riser, wherein fluid leaving said connecting line passes through said injector, creating a driving head which draws fluid up said riser.

8. An evaporator system as recited in claim 1, and further comprising a control valve between said feedwater pump and said first evaporator inlet, for maintaining the water level in said drum.

9. An evaporator system, comprising:

a drum;

a substantially vertical gas duct through which hot gas can pass;

first and second evaporator sections located in said gas duct, each of said evaporator sections defining an inlet and an outlet and including substantially horizontal heat-absorbing tubes;

a downcomer from said drum to the inlet of said second evaporator section;

a riser from the outlet of said second evaporator section to said drum;

a feedwater pump in communication with the inlet of said first evaporator section; and a connecting line providing fluid communication from the outlet of said first evaporator section to said drum.

10. An evaporator system as recited in claim 9, wherein said connecting line and said riser merge together to form a combined riser, and further comprising an injector at the point at which the connecting line and riser merge, so that the fluid leaving said first evaporator section passes through said injector, creating a driving head which draws fluid through said second evaporator section and out the combined riser.

11. A method for enhancing the circulation in a drum-type waste heat recovery boiler having substantially horizontal heat-absorbing evaporator tubes, comprising the steps of:

dividing the heat-absorbing tubes into a first evaporator section and a second evaporator section; wherein said first and second evaporator sections are connected in parallel with the drum;

providing forced circulation in said first evaporator section, using the driving head of a feedwater pump; and relying primarily on natural circulation in said second evaporator section.

12. A method as recited in claim 11, and further enhancing the circulation in said second evaporator section by combining the fluids leaving said first and second evaporator sections and passing the fluid leaving said first evaporator section through an injector where the fluids from the first and second evaporator sections are combined, which creates an additional driving head to drive fluid through said second evaporator section.

13. A method as recited in claim 12, and further controlling a valve between said feedwater pump and said first evaporator section in order to maintain the proper water level in said drum.

14. A method as recited in claim 13, and further providing an economizer section, so that water is pumped from said feedwater pump, through said economizer section, and through said first evaporator section to the drum, and further providing a first recirculation line from the output of said economizer back to the inlet of the feedwater pump and providing a control valve in the first recirculation line, and controlling the recirculation control valve so as to prevent steaming in the economizer.

15. A method as recited in claim 14, and further providing a second recirculation line in communication with the drum and with the feedwater pump inlet, and including a second recirculation line control valve, and controlling said second recirculation line control valve to maintain a desired flow rate through the first evaporator section even while decreasing the level in the drum.

* * * * *